United States Patent [19]

Owens et al.

[11] 3,975,015

[45] Aug. 17, 1976

[54] ARM RESTRAINING DEVICE

[76] Inventors: Paul J. Owens, 1979 Myrtle Ave.; Ben Maples, Jr., 2432 Pasadena Ave., Apt. 4, both of Long Beach, Calif. 90806

[22] Filed: May 1, 1975

[21] Appl. No.: 573,608

Related U.S. Application Data

[63] Continuation of Ser. No. 453,598, March 22, 1974, abandoned.

[52] U.S. Cl. ..... 273/54 B; 128/87 R; 128/165; 273/189 A

[51] Int. Cl.[2] ..... A63B 71/14

[58] Field of Search ..... 273/54 B, 183 B, 189 A; 128/77, 87 R, 89 R, 165

[56] References Cited

UNITED STATES PATENTS

| | | | |
|---|---|---|---|
| 802,623 | 10/1905 | Camp | 273/189 A |
| 1,414,012 | 4/1922 | Flint | 273/189 A |
| 3,658,345 | 4/1972 | Siggson | 273/189 A |
| 3,700,245 | 10/1972 | Nannini | 273/189 A |
| 3,888,244 | 6/1975 | Lebold | 128/165 |
| 3,900,199 | 8/1975 | McGonagle | 273/189 A |

FOREIGN PATENTS OR APPLICATIONS

| | | | |
|---|---|---|---|
| 346,649 | 7/1960 | Switzerland | 128/87 R |

*Primary Examiner*—Anton O. Oechsle
*Attorney, Agent, or Firm*—I. Michael Bak-Boychuk

[57] ABSTRACT

An arm restraining device adapted to be attached over the frontal surface of an arm including a rigid support member adapted to partly surround the elbow section of the arm, an inner and outer flexible membrane disposed in sandwiching relationship on either side of the support member and belt segments extending from the longitudinal edges of the membranes for surrounding the arm. The support member is generally shaped in the form of a longitudinal section of a cylinder, the longitudinal axis of the cylinder being further convolved to retain the elbow in a partly bent position. A layer of foam rubber is further interposed between the inner membrane and the arm to distribute the forces produced by inadvertent elbow articulation over large areas of the arm.

4 Claims, 4 Drawing Figures

FIG. 1
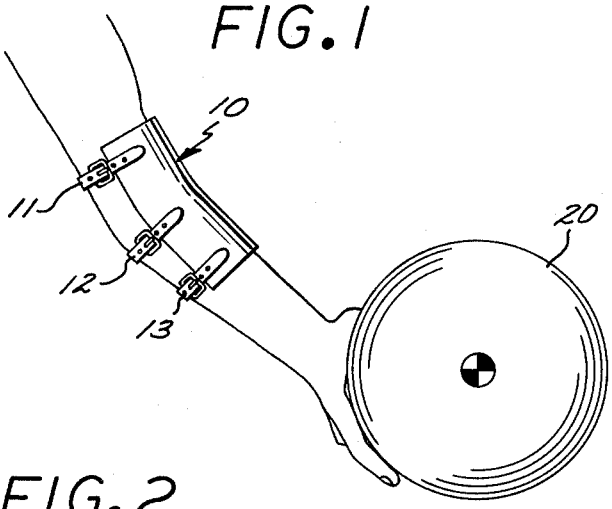
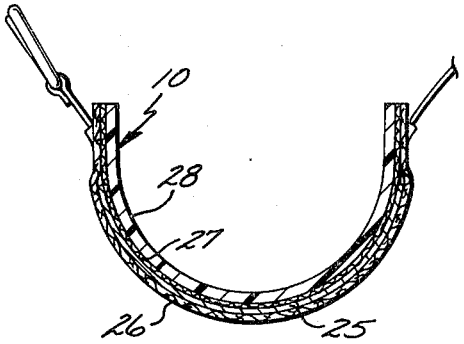
FIG. 4
FIG. 2
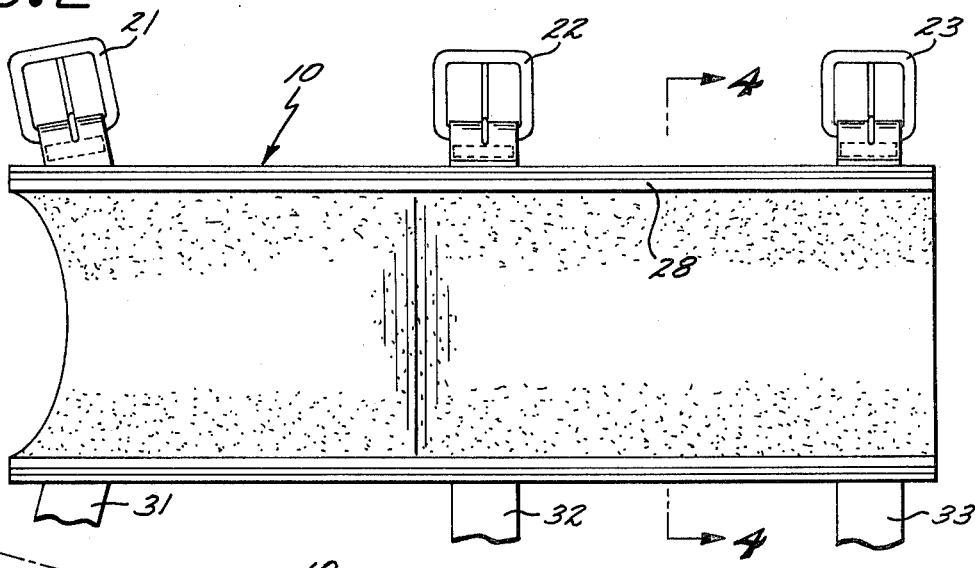
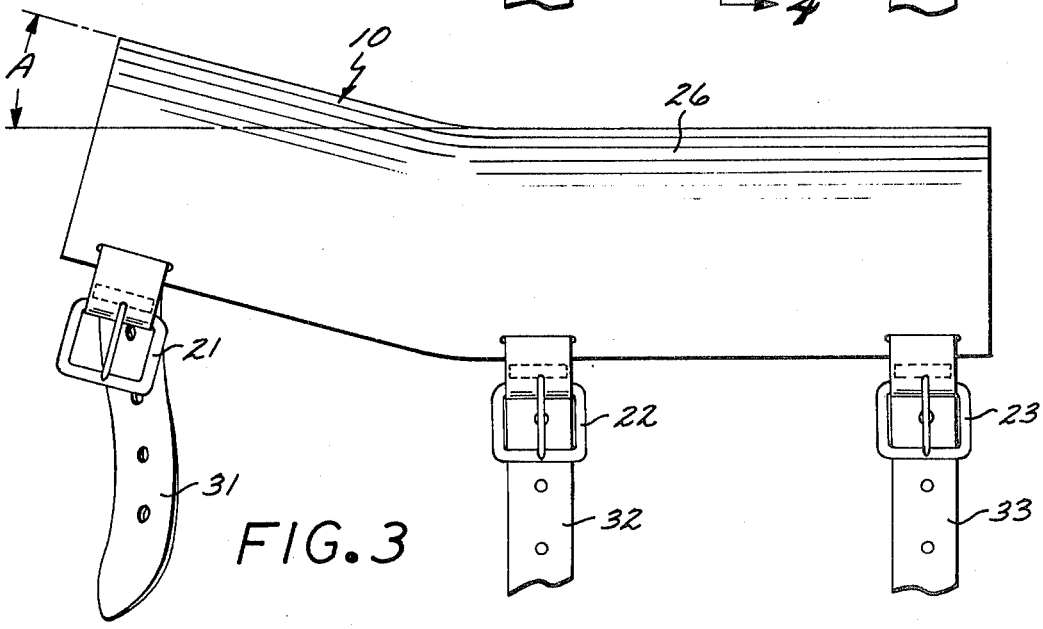
FIG. 3

ARM RESTRAINING DEVICE

CROSS-REFERENCE TO RELATED APPLICATION

The present application is a Continuation of U.S. Ser. No. 453,598, filed Mar. 22, 1974, and now abandoned, for ARM RESTRAINING DEVICE. The benefit of the earlier filing date is claimed for the subject matter common to both applications.

BACKGROUND OF THE INVENTION

1. Field of the Invention

The present invention reltes to limb restraining devices and more particularly to elbow restraining devices associated with athletic activity.

2. Description of the Prior Art

In various athletic endeavors and particularly in bowling, it is often desirable to take full advantage of the natural pivotal stroke of any limb such as an arm in order to obtain, with minimal effort, constant speed and high accuracy during delivery of the bowling ball. Generally, however, most users and typically the beginning bowler experience difficulty in supporting the ball with the arm in a fully extending position and therefore tend to foreshorten the pivotal length of the arm by bending at the elbow. In this position the player tends to rely on quick elbow articulation concurrent with the release of the ball in order to increase the speed of delivery and to control the ball. Such habits typically result in awkward balancing problems as well as awkward use of musculature to the detriment of the player. Most prior art devices, such as those shown in U.S. Pat. Nos. 3,419,276; 2,809,042 and 3,000,633 are directed at aligning or guiding the pivotal articulation of the arm rather than restraining the articulation at the elbow. Such devices provide an external pivot which in effect limits the pivotal degree of freedom of either the elbow or the shoulder but which permits elbow articulation during the delivery of the ball with the attendant loss of accuracy and balance.

SUMMARY OF THE INVENTION

Accordingly, it is the general purpose and object of the present invention to provide an elbow motion restraining device which is conveniently attached to the person of the player and which restrains the arm to a fixed angle of bend. Other objects of the invention are to provide an elbow restraining device which is conveniently adapted to receive arm dimensions of various players and which furthermore is convenient and comfortable to wear and convenient to manufacture.

These and other objects are accomplished within the present invention by providing a rigid support member conformed in the manner of a longitudinal section of a cylinder, such member being further convolved to an external bend of approximately 15° along the longitudinal axis thereof. In cross section the support member is conformed to receive the frontal surfaces of adjacent sections of the upper and lower arm of the player, the longitudinal convolution of the member being adapted to fit into the crook of the elbow. This support member is received in a sandwiched arrangement between two layers of leather or other flexible material, such leather layers extending beyond the longitudinal edges of the support member to be joined together and to attach to a plurality of belt segments disposed in transverse complementary pairs and being adapted to be joined together to surround the arm. Interposed between the interior layer and the arm is a foam rubber sheet, such sheet being deformable in cross section in order to adapt to the various individual arm contours of the player. It is to be noted that the support member is conformed in a manner of a section of a cylinder extending over less than half of the circular section where the sandwiching leather layers extend from the longitudinal edges of the support member beyond the longitudinal edges thereof to contain arms of various dimensions. The intersection or the longitudinal convolution of the support member is radiused in order to remove any sharp projections which could cause discomfort to the wearer. The longitudinal edges of the sandwiching membranes specifically connect to belt segments extending from each corner of the elbow restraining device and one belt segment extending proximate and immediately below the elbow to restrain the lower arm. In this manner, a restraining device is formed which precludes elbow articulation to foreshorten the pivot length about the shoulder, thereby forcing the wearer to maintain the ball at a comfortable extension relative the shoulder pivot. The restraining device is furthermore convolved to allow a 15° or thereabout bend in the elbow, such bend being necessary in order to place the hand and the wrist behind the ball during the release for optimum control.

BRIEF DESCRIPTION OF THE DRAWINGS

FIG. 1 is an illustration drawn in perspective showing the inventive elbow restraining device attached in the normal position of use;

FIG. 2 is a bottom view of the elbow restraining device shown in FIG. 1;

FIG. 3 is the side view of the elbow restraining device shown in FIG. 2; and FIG. 4 is a sectional view taken along line 4—4 of FIG. 2.

DESCRIPTION OF THE SPECIFIC EMBODIMENT

While the inventive elbow restraining device is described herin with reference to a bowling game and is particularly useful therefor, such description is not intended to be limiting on the scope of use thereof and other applications of the elbow restraining device are intended to be within the scope of the present invention.

As shown in FIG. 1, an inventive elbow restraining device, generally designated by the numeral 10, is disposed to overlay the frontal surface or the interior of the elbow of a player. The longitudinal edges of the restraining device 10 are attached to a plurality of adjustable belt segments 11, 12 and 13, segments 12 and 13 being disposed to surround the lower arm section, i.e. extending around the arm section below the elbow pivot designated P to restrain the lower arm against the interior surface of the restraining section 10. The upper arm is similarly restrained at a point on the upper arm and above the pivot P by belt segment 11. The device 10 is rigid or form retaining and therefore restrains the inward articulation of the lower arm relative the upper arm when secured in this manner by the belt segments 11, 12 and 13. In order to align the wrist of the player behind the center of gravity of the ball 20, the restraining device 10 is convolved to describe a longitudinal angle of about 15° having an apex substatially proximate the pivot P of the elbow.

As shown in FIGS. 2, 3 and 4, device 10 comprises a rigid inner support member 25, made of sheet metal such as steel or aluminum, and formed in the manner of a longitudinal cylindrical section conformed to receive within the interior the arm of the player. The sectional dimensions of member 25 are limited to less than half of a circular periphery of the cylinder where the longitudinal peripheral axis of member 25 is further convolved to describe an exteriorally projecting angle A of approximately 15°. It is intended that the apex of the angle A be aligned during attachment within the crook of the elbow. The support member 25 is received in a sandwiched arrangement between two layers of leather or other flexible membrane, respectively 26 and 27. Membrane 26 is disposed in surrounding relationship around the exterior surface of the support member 25 while membrane 27 is disposed within the interior of the support member 25 extending contiguously along the interior surfaces thereof to join membrane 26 along the longitudinal edges of member 25. The sectional dimensions of support member 25 are further conformed to the dimensions of the player's arm, being limited to less than one-half of the circumference of the cylinder, whereby the extending ends of membranes 26 and 27 can be deformed towards the interior of the cylinder to surround the player's arm. Such alignment of the unsupported ends of membranes 26 and 27 is provided by a plurality of belt segments 11, 12 and 13 attached thereto, segments 11, 12 and 13 including corresponding belt buckles 21, 22 and 23 and associated straps 31, 32 and 33.

The interior surface of membrane 27 is lined with a contiguously attached layer of foram rubber 28 which acts to distribute the load over large areas of the arm when inadvertent elbow articulation occurs. Such foam rubber layer 28 may be formed from open celled material to permit evaporation of perspiration built up over the adjacent arm surface.

In operation the restraining device 10 is placed over the bowling arm of the player and is secured thereto by appropriate attachment of the belt segments 11, 12 and 13. The vertical alignment of device 10 relative the arm is determined by the convolution in the longitudinal axis thereof, which, in order to maintain comfort, must be aligned with the crook of the elbow. The device 10 then secures the elbow to a predetermined fixed amount of deflection, as set by the angle A, of the angle of convolution of the member 25, such angle providing the proper alignment of the wrist relative the ball 20. The limited elasticity of belt segments 11, 12 and 13 and the compressibility of the layer 28 allow for some motion of te arm in order to properly control ball delivery while at the same time restraining the arm from any elbow articulation which would tend to substantially reduce the pivotal length from the shoulder.

Some of the many advantages of the present invention should now be readily apparent. The invention provides in a conveniently assembled structure a device which comfortably restrains the elbow of a player to an optimal alignment and which furthermore is sufficiently deformable to allow for proper control.

Obviously, many modifications and variations of the present invention may be made with regard to the foregoing detailed description without departing from the spirit of the invention.

We claim:

1. An arm restraining device for use in bowling activities, comprising:

a. a rigid shell support structure being continuous in contour conformed into a substantially longitudinally extending segment of a cylinder having linearly extending first and second sections, said first and second linearly extending sections intersecting each other at a predetermined angle proximate the longitudinal center of said cylinder and adapted to be secured substantially contiguous the biceps and inner forearm for distributing force loads over a substantial arm area:

b. an exteriorly overlying, partly expandable membrane disposed over the exterior of said continuously contoured support structure;

c. an interiorly overlying, partly extendable membrane disposed over the interior of said support structure secured to said exteriorly overlying membrane distal of the longitudinal edges of said support structure;

d. a layer of open cell foam attached to said interiorly overlying member, said layer being positionally located in mating engagement with said biceps and inner forearm for absorbing force loads and perspiration; and, e. securing means attached proximate the opposing longitudinal edges and center of said membrane for securing an arm on the interior of said structure in a predetermined joint alignment.

2. Apparatus according to claim 1 wherein:

said support structure is convolved to overlie, in partial surrounding arrangement, the interior of an elbow joint of a player; and said securing means includes straps aligned to surround the upper arm, the lower arm and said elbow joint for elastically securing said elbow joint in conforming relationship with said support structure.

3. Apparatus according to claim 2 wherein:

the external angle of intersection of said sections is approximately fifteen degrees.

4. Apparatus according to claim 3 wherein:

said support structure is conformed in lateral section to a cylindrical dimension just greater than the dimension of the upper and lower arms, whereby partial rotary articulation of said lower arm can occur within said support structure.

* * * * *